US005132590A

United States Patent [19]

Kimoto et al.

[11] Patent Number: 5,132,590

[45] Date of Patent: Jul. 21, 1992

[54] GAS DISCHARGE TUBE CAPABLE OF LIGHTING IN DIFFERENT COLORS

[76] Inventors: Masaaki Kimoto, c/o Kimoto Sign Co., Ltd. 4-28 Fukaekita, 2-Chome, Osaka, Japan, 537; Ryohei Itatani, 11-18 Daigo-Ohtaka-cha, Fushimi-Ku Kyoto, Japan, 601-13; Ryohko Masatoshi, 2-64 Harimacho, Nozoe-higashi Kako-gun Hyogo, Japan, 673-01

[21] Appl. No.: 600,167

[22] Filed: Oct. 17, 1990

Related U.S. Application Data

[63] Continuation of Ser. No. 317,099, Feb. 28, 1989, abandoned, which is a continuation-in-part of Ser. No. 855,070, Apr. 23, 1986, abandoned.

[30] Foreign Application Priority Data

Apr. 24, 1985 [JP] Japan ..... 60-89676

[51] Int. Cl.[5] ..... H01J 1/62

[52] U.S. Cl. ..... 313/485; 313/486; 313/487; 313/642

[58] Field of Search ..... 313/487, 642, 484–486

[56] References Cited

U.S. PATENT DOCUMENTS

| | | | |
|---|---|---|---|
| 1,792,347 | 2/1931 | Zecher | 313/642 X |
| 2,030,402 | 2/1936 | Ruttenauer | 313/487 |
| 2,170,066 | 8/1939 | Ruben | 313/486 |
| 2,207,174 | 7/1940 | Jenkins | 313/487 |
| 2,316,366 | 4/1943 | Ruttenauer et al. | 313/486 |
| 2,419,902 | 4/1947 | Mager | 313/486 |
| 3,255,373 | 6/1966 | Van Broekhoven et al. | 313/486 |
| 3,351,796 | 11/1967 | Apple et al. | 313/486 |
| 3,416,019 | 12/1968 | Kaduk | 313/486 |

FOREIGN PATENT DOCUMENTS 53-42386 11/1978 Japan .

*Primary Examiner*—Donald J. Yusko
*Assistant Examiner*—Michael Horabik
*Attorney, Agent, or Firm*—Lyon & Lyon

[57] ABSTRACT

A gas discharge tube that is capable of lighting in different colors. The gas discharge tube, which may contain neon and mercury vapor, and which has its inner surface coated with a photoluminescent layer, is energized with a pulse current. The resultant color of the light emitted from the gas discharge tube depends on the combination of the pulse shapes and duty factors constituting the pulse current.

2 Claims, 3 Drawing Sheets

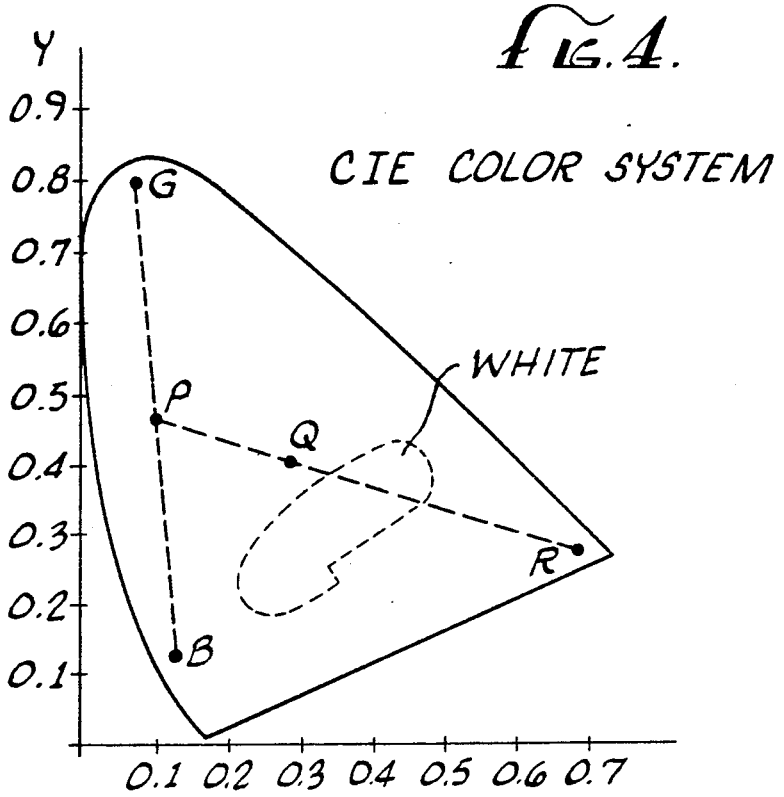
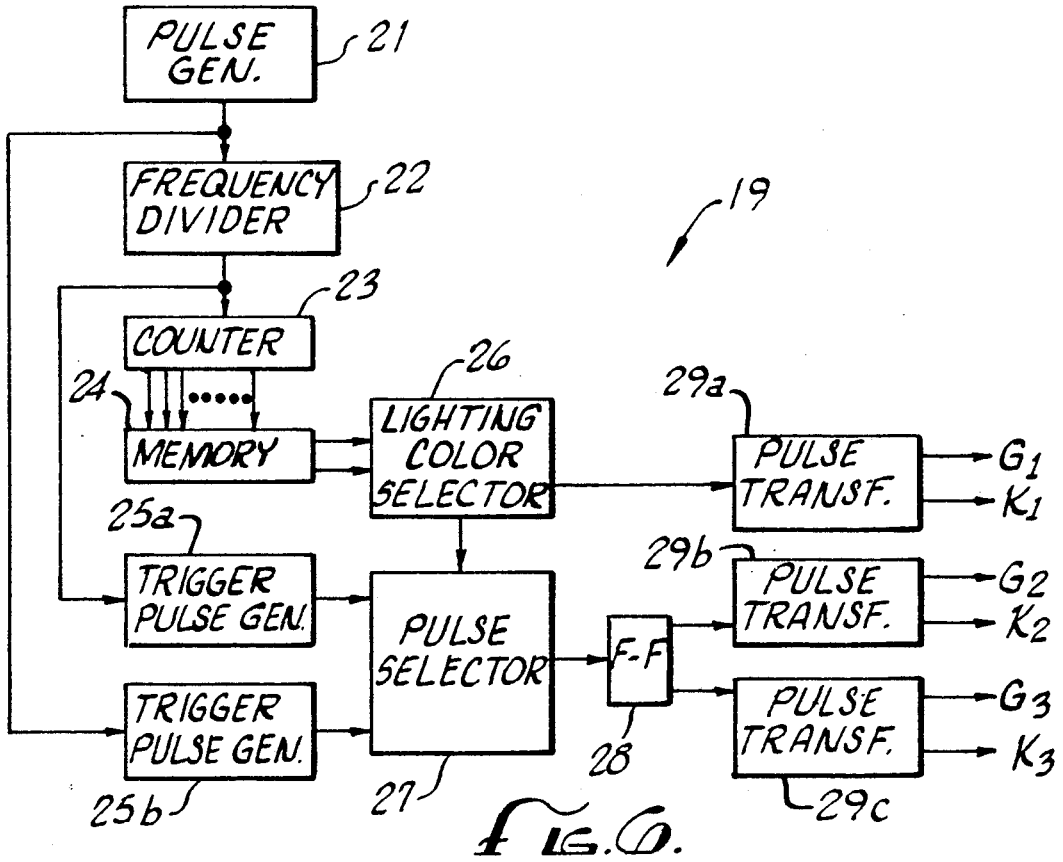
FIG. 6.

GAS DISCHARGE TUBE CAPABLE OF LIGHTING IN DIFFERENT COLORS

This is a continuation of co-pending application Ser. No. 07/317,099, filed on Feb. 28, 1989 now 'Abandoned' which is a continuation-in-part of co-pending application Ser. No. 06/855,070 filed on Apr. 23, 1986 now 'Abandoned'.

FIELD OF THE INVENTION

The field of the present invention is gas discharge tubes capable of lighting in different colors.

BACKGROUND OF THE INVENTION

The use of luminous gaseous discharge tubes as a source of light has to date found wide application. Such tubes are generally filled with a pressurized gas and electrically energized to illuminate in a color corresponding to the selected gas within. Each tube, consequently, is effectively capable of displaying only a single color.

More recently, a gas discharge tube capable of lighting in multiple colors has been disclosed in Japanese Patent Publication No. 53-42386. This multi-color gas discharge tube, containing therein two kinds of discharge gases different in excitation energy, is energized with a pulse current. According to the shape and duty cycle of the pulse, either of the gases in the tube is selectively excited to make the tube light in a color characteristic of the excited one of the gases. Additionally, the tube can be made luminous not only in one of the two colors by suitably selecting the constitution of the pulse current in accordance with the excitation energy of the selected gas, but also in any color determined from the combination of the two colors by constituting the pulse current with a suitable combination of two kinds of pulse shapes and duty factors.

The kinds of discharge gases, however, are usually restricted to neon (emitting a light of red) and mercury vapor (emitting a light of blue in the visible light region), so that the luminous light colors are limited to red, blue and a color obtained from the combination of them. Therefore, the prior art gas discharge tube can not be made luminous, for instance, in yellow and green.

SUMMARY OF THE INVENTION

The present invention is directed to an improved multicolor gas discharge tube capable of lighting in a wide range of colors. To this end, the gas discharge tube contains selected discharge gases and has its inner surface coated with a selected photoluminescent material.

BRIEF DESCRIPTION OF THE DRAWINGS

FIG. 4 is a CIE Color System graph showing an envelope of colors obtainable from one embodiment of the present invention.

FIG. 6 is a schematic representation of a circuit to control the power source shown in FIG. 5.

DETAILED DESCRIPTION OF THE PREFERRED EMBODIMENT

Figure 1:
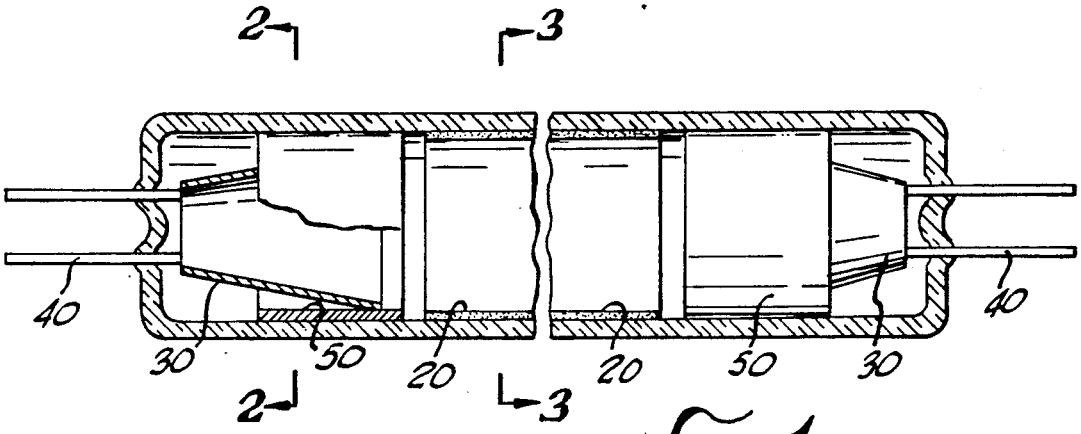
FIG. 1 is a cross-sectional view with a portion broken away for clarity, illustrating a gas discharge tube constructed in accordance with the present invention.
Figure 2:
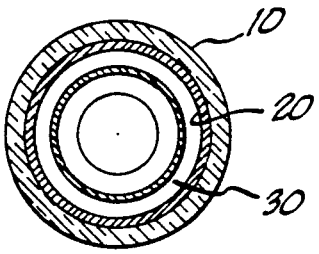
FIG. 2 is a cross-sectional view taken along line 2—2 of FIG. 1.
Figure 3:
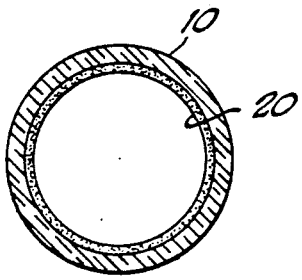
FIG. 3 is a cross-sectional view taken along line 3—3 of FIG. 1.

Referring to FIG. 1, a transparent glass tube 10 is coated on its inner surface with a thin photoluminescent layer 20. A pair of discharge electrodes 30 are provided at both ends of the tube 10, the electrodes 30 having their respective leads 40 penetrating the end wall of the tube 10 and extending outwardly thereof. Cylindrical mica sheets 50 surround the electrodes 30 to protect the glass tube 10 from high temperatures caused by heating the electrodes 30 during a tube evacuating process for liberating the gases absorbed by the electrodes 30.

In the present embodiment, the glass tube 10 contains neon and mercury vapor as discharge gases, and the photoluminescent layer 20 is made of zinc silicate containing manganese as an activator. In such a constitution of the gas discharge tube, the neon gas is excited so as to emit a red light while the mercury vapor is excited so as to emit invisible ultraviolet light, not a visible light of blue. Excited by the ultraviolet light, the photoluminescent zinc silicate emits a visible light of green. Accordingly, the gas discharge tube based on this embodiment can be made luminous selectively in red, green or in a yellow or yellowish color given by a suitable combination of the red light emitted from the neon gas and the green light which the photoluminescent layer 20 emits.

The present invention can also be embodied by using a calcium tungstate, calcium halo-phosphate or other desirable photoluminescent material for the photoluminescent layer 20.

Further, the present invention can also be embodied by employing a photoluminescent layer 20 comprising a mixture of calcium tungstate ($CaW0_4$) and manganese-doped silicate ($Zn_2Si_4/Mn$). By controlling the ratio of these coating materials, the discharge tube containing a mixture of calcium tungstate ($CaWO_4$) and manganese-in a range of colors including white light.

Thus, with the two photoluminescent materials $CaWO_4$ and $Zn_2Si_4/Mn$ applied to the inner surface of the mercury-neon mixed gas discharge tue, the $CaWO_4$ and $Zn_2Si_4/Mn$ is excited by the ultraviolet light emitted by mercury to emit blue and green, respectively, while the neon emits a visible light of red. This means that the color of light provided in based on a combination of three primary colors as shown in detail in the CIE Color System represented in FIG. 4.

Points B, G and R of FIG. 4 represent three primary colors respectively emitted by the $CaWO_4$ and $Zn_2Si_4/Mn$ photoluminescent materials and the mercury-neon gas. The blue and the green colors represented by the points B and G are mixed to give a resultant color corresponding to the point P (a color between pure blue and pure green), whose position is determined by the mixing ratio of the two photoluminescent materials. Further, the density of the color P depends on the strength of the ultraviolet light emitted by mercury that excites the photoluminescent materials, while the density of the color R (red) is determined by the strength of the red light emitted by neon.

Therefore, a final resultant color represented by point Q is determined by the emission ratio between the ultraviolet and visible red emitted by the mercury-neon gas mixture. By varying the duty ratio or rise-up speed of the pulse discharge voltage imposed on the gas discharge tube, a single gas discharge tube can be made to light either at any fixed color on the line between points P and R, through the white region, or time-dependently varying various colors on the same line.

In general, neon is excited favorably with a smaller duty ratio and higher rise-up speed of the pulse, while a larger duty ratio and lower rise-up speed are favorable in exciting mercury. Two examples of a power source to operate gas discharge tubes based on the present invention may be described.

Figure 5:
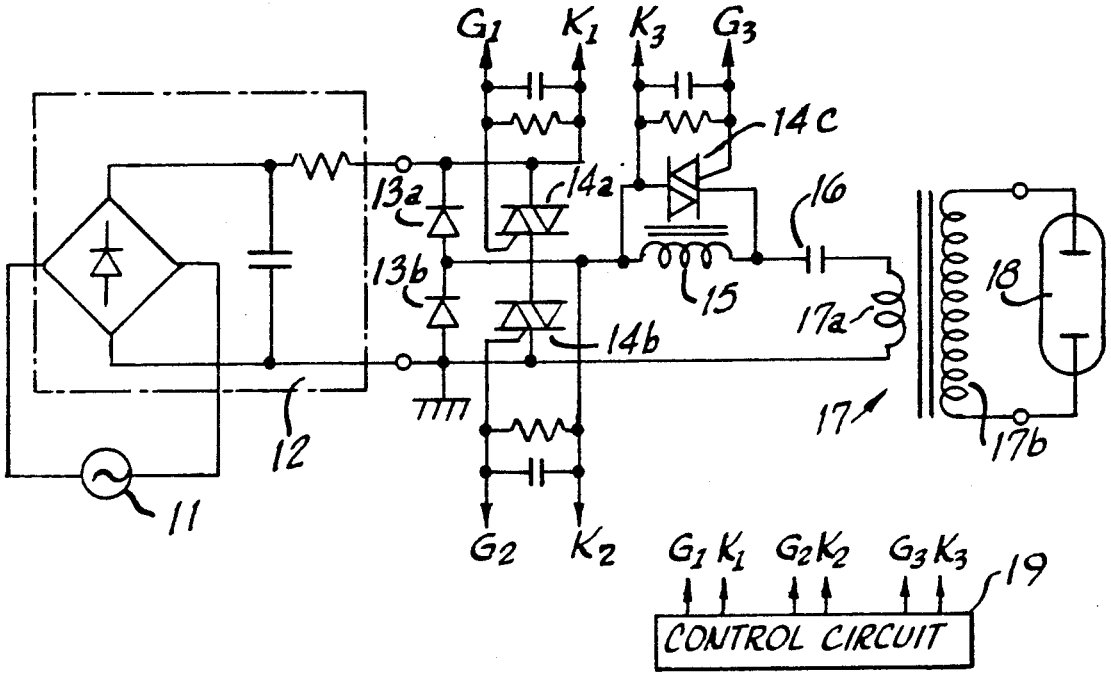
FIG. 5 is a schematic representation of a power source to operate a gas-discharge tube constructed in accordance with the present invention.

FIG. 5 shows a power source wherein a DC voltage obtained by rectifying a commercial AC power source 11 with a rectifier circuit 12 is supplied to the primary winding 17*a* of a transformer 17 through a thyristor 14*a*, a reactor 15 and a capacitor 16. Further, the reactor 15 is bridged by a thyristor 14*c*. FIG. 6 illustrates a control circuit comprising pulse generators 25*a* and 25*b*, a lighting color selector 26, a pulse selector 27, a flip-flop 28 and pulse transformers 29*a*, 29*b* and 29*c*. The counter 23 outputs signals to select the addresses in the memory 24, in which is stored the information for the lighting color of the discharge lamp 18 (FIG. 5). The lighting color selector 26, which is controlled by the outputs from the memory 24, not only operates the pulse selector 27 so as to select a combination of the two kinds of trigger pulses outputted from the two trigger pulse generators 25*a* and 25*b*, but also outputs, toward the pulse transformer 29*a*, a pulse signal to control the thyristor 14*a* (FIG. 5). The output of the pulse transformer 29*a* is led to the thyristor 14*a*. The trigger pulses selected by and outputted from the pulse selector 27 operate the flip-flop 28. The output pulses alternately outputted from the flip-flop 28 are inputted to the pulse transformers 29*b* or 29*c*. The pulse transformer 29*b* and 29*c* have their outputs led to the thyristors 14*b* and 14*c* (FIG. 5), respectively.

Figure 7:
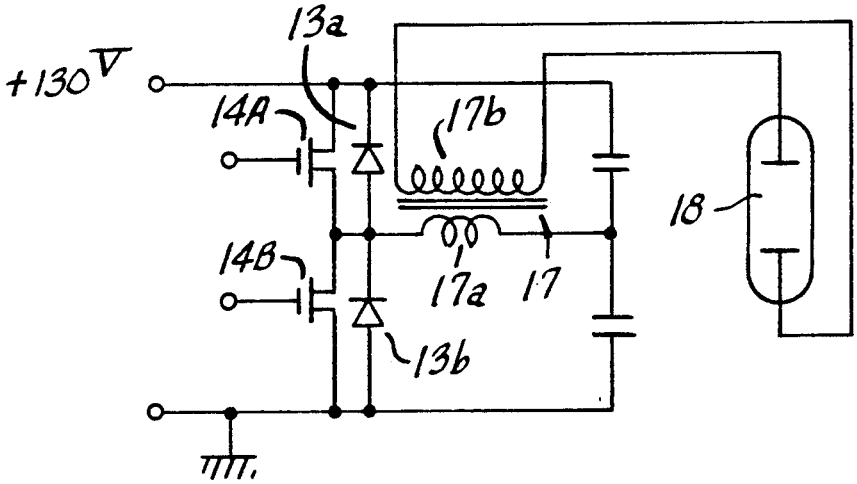
FIG. 7 shows another power source capable of operating a gas discharge tube constructed in accordance with the present invention.

An alternative power source is shown in FIG. 7, in which a rectifier circuit corresponding to that of FIG. 5 is omitted for simplification of the drawing. In this power source, which constitutes a so-called inverter circuit, MOS FETs 14A and 14B respectively correspond functionally to the thyristors 14*a* and 14*b* of FIG. 5, but no element corresponding to the thyristor 14*c* is provided. This power source is also controlled by a control circuit similar to that shown in FIG. 6.

Thus, an improved gas discharge tube capable of lighting in a wide range of colors is disclosed.

While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A lighting apparatus comprising: a gas discharge tube containing therein a mixture of mercury vapor and neon gas, said discharge tube having an inner surface coated with a photoluminescent material, and means for varying the duty ratio of the pulse discharge voltage imposed on the gas discharge tube such that when said pulse discharge voltage is imposed to excite neon, the neon excitation is accompanied by a mercury excitation, said mercury excitation emitting an ultraviolet light which in combination with said neon excitation and said fluorescent material, produces a range of colors, including white light.

2. A lighting apparatus as defined in claim 1, wherein said photoluminescent material is a mixture of calcium tungstate and manganese-doped zinc silicate.

* * * * *

UNITED STATES PATENT AND TRADEMARK OFFICE

CERTIFICATE OF CORRECTION

PATENT NO. : 5,132,590

DATED : July 21, 1992

INVENTOR(S) : Masaaki Kimoto et al.

It is certified that error appears in the above-identified patent and that said Letters Patent is hereby corrected as shown below:

Column 2, line 42, delete "mixture of calcium tungstate ($CaWO_4$) and manganese" and insert --mixture of mercury and neon gas can be made to light.--

Signed and Sealed this

First Day of February, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,132,590

DATED : July 21, 1992

INVENTOR(S) : Masaaki Kimoto et al.

It is certified that error appears in the above-identified patent and that said Letters Patent is hereby corrected as shown below:

Claim 1 (column 4, line 31), replace "fluorescent" with --photoluminescent.--

Signed and Sealed this

Ninth Day of August, 1994

*Attest:*

*Attesting Officer*

BRUCE LEHMAN

*Commissioner of Patents and Trademarks*